United States Patent [19]

Schmitt et al.

[11] 4,442,664

[45] Apr. 17, 1984

[54] FALSE-TWIST APPARATUS

[75] Inventors: Günther Schmitt; Günter Oppl, both of Hammelburg; Kirit Patel, Elfershausen, all of Fed. Rep. of Germany

[73] Assignee: FAG Kugelfischer Georg Schäfer & Co., Schweinfurt, Fed. Rep. of Germany

[21] Appl. No.: 383,174

[22] Filed: May 28, 1982

[30] Foreign Application Priority Data

May 30, 1981 [DE] Fed. Rep. of Germany ..... 3121614

[51] Int. Cl.[3] ..... D02G 1/04

[52] U.S. Cl. ..... 57/339; 57/280; 57/348

[58] Field of Search ..... 57/338-340, 57/348, 280

[56] References Cited

U.S. PATENT DOCUMENTS

| | | | |
|---|---|---|---|
| 2,923,121 | 2/1960 | Tully | 57/339 |
| 4,047,374 | 9/1977 | Venot | 57/338 |
| 4,226,080 | 10/1980 | Bieber et al. | 57/339 |

FOREIGN PATENT DOCUMENTS

| | | |
|---|---|---|
| 2339416 | 4/1974 | Fed. Rep. of Germany . |
| 2943279 | 5/1981 | Fed. Rep. of Germany . |

*Primary Examiner*—John Petrakes

*Attorney, Agent, or Firm*—Karl F. Ross; Herbert Dubno

[57] ABSTRACT

A false twist device has a pair of fixedly positioned spindles whose whorls are driven by a tangential belt and whose friction discs overlap wtih each other and with the friction discs of a swingable spindle mounted on an arm which can be angularly displaced about a pivot axis parallel to the spindle axis but spaced outwardly from the triangle defined by the axes of the spindles.

6 Claims, 3 Drawing Figures

FALSE-TWIST APPARATUS

CROSS REFERENCE TO RELATED APPLICATIONS

The present application is related to the commonly assigned copending application Ser. No. 200,552 filed 24 Oct. 1980 (now U.S. Pat. No. 4,333,308 issued 8 June 1982).

The application also relates to a false-twist device of the type described in copending application Ser. No. 370,052 filed 20 Apr. 1982 also commonly assigned with the present case (see also U.S. Pat. No. 4,226,080 and the art of record in Ser. No. 200,552).

This art and the art cited below represent the best art known to applicants relevant to the present invention.

FIELD OF THE INVENTION

Our present invention relates to a false-twist device and, more particularly, to a false-twist device comprising three friction-disc or wheel spindles rotatable about respective axes disposed at the vertices of a triangle and between which a yarn is fed so that a false twist can be imparted thereto by the principles described, for example in copending application Ser. No. 200, 552, in German open application DE-OS 2,339,416 and in German open application DE-OS 2,943,279, the latter corresponding to the U.S. application Ser. No. 200,552.

BACKGROUND OF THE INVENTION

It is known to provide false-twist devices of the aforedescribed type which operate in accordance with the principles of most false-twist systems, i.e. by frictionally engaging a yarn between two or more moving surfaces thereby imparting a twist in one or another direction to the yarn as it is drawn through the device.

In false-twist devices of the type with which the present invention is most concerned, three spaced-apart mutually parallel spindles are disposed with their axes at the vertices of a triangle, the spindles each carrying a number of axially spaced friction discs which interdigitate and overlap at least in a central region between these axes through which the yarn is passed so that the yarn is frictionally engaged by the discs or wheels and receives a false twist of the S-type or the Z-type(see especially application Ser. No. 200,552 and German open application 2,943,279).

The spindles are driven by at least one belt drive and thus each carries at least one friction disc so that the friction discs at least in the operative position overlap and the axes or centers of the spindles lie at the vertices of a triangle, especially an equilateral triangle.

As described in German open application 2,339,416, at least one of the spindles should be swingable relative to the others so that its disc can be brought out of its overlapping relationship with at least one other of the discs.

The swinging movement of one of the spindles and the disc or discs carried thereby is important because it permits the yarn to be fed into the assembly or removed therefrom.

In practice, it is found to be important to continue to drive the swung spindle and its discs, i.e. to continue to rotate the latter even after it has been swung from the closed position to the open position for receiving or removing the yarn. If the swingable spindle is pivotally mounted so as to swing about the axis of one of the other spindles, the interaxial spacing of these two spindles remains constant and hence a belt coupling these two spindles for driving the swingable spindle, can continue to rotate the latter in the open position without difficulty and without complex means for maintaining belt tension because the sheaves over which the belt passes are spaced at a constant distance from one another.

However, it has now been found that the swingable mounting of one spindle at the axis of another spindle is a disadvantage since the size of the unit must be increased in the axial direction to provide for journaling of arms or the like carrying the swingable spindle at the axis of the stationary spindle with which the swingable spindle is connected by the belt.

Especially with a false-twist device of small friction disc diameter this can be highly disadvantageous because in the region of the spindle bearings there is only a limited amount of space or there may not be any space at which journaling of the arms carrying the swingable spindle can be provided.

In practice, the temperature in the region of the bearings tends to increase inordinately when the pivots for the swingable spindle and discs are provided coaxially or in axial alignment with the rotational axis of the stationary spindle and disc assembly; vibrations or oscillations tend to develop which can cause undesired opening of the device and, in general, the operation of the device has not been found to be fully satisfactory.

OBJECTS OF THE INVENTION

It is the principal object of the present invention to provide a false-twist device which constitutes an improvement over the system of German open application No. 2,339,416 and avoids the disadvantages set forth above.

Another object of this invention is to provide a false-twist device of the aforedescribed type which, with relatively simple, inexpensive and compact structure precluding damage to the spindle bearings, can be used with spindles whose friction discs are of small diameter, and which prevents inadvertent opening of the device.

Yet another object of our invention is to provide an improved system for imparting a false twist to the yarn which has greater security against inadvertent opening and greater operative reliability than earlier devices.

SUMMARY OF THE INVENTION

These objects and others which will become apparent hereinafter are attained, in accordance with the invention, in a false-twist device of the aforedescribed type having three mutually parallel spindles whose axis lie at the vertices of a triangle (preferably an equilateral triangle in a closed condition of the device), a belt drive coupled with two of these spindles and a further belt coupling one of the two 'atter spindles with a third swingable spindle, the spindles each being provided with at least one friction disc such that the discs overlap in the closed or operating position and are capable of imparting a false twist to a yarn passed between these discs, and means supporting the swingable spindle so that it can pivot about a pivot axis parallel to the aforementioned axis and offset therefrom and preferably located outside the aforementioned triangle so that the swingable spindle is drivable by the coupling belt even in its outwardly swung or open position since the spacing between the centers of the swingable spindle or spindles of the stationary assembly changes only minimally during the pivotal movements between the open and closed positions, i.e. by at most a spacing equal to the maximum permissible sag or "give" of the coupling belt.

According to a further feature of the invention, the two stationarily positioned spindles tangentially engage a belt while the coupling belt is a toothed or cog belt driven by one of the stationarily positioned spindles.

It has been found to be advantageous, moreover, to provide that the spacing between the pivot and the center of the swingable spindle is greater than the distance between this center and the center of the stationarily positioned spindle to which it is connected by the coupling belt.

It has also been found to be desirable to construct the device so that the arc height of the crescent which is generated when one swings an arc about the pivot with a radius equal to the spacing between the center of the swingable spindle and the pivot and a further arc about the center of the stationary spindle with a radius equal to the distance between the swingable and stationary spindles, is less than or equal to the maximum permissible sag of the coupling belt.

It may be noted that German open application 2,943,279 and U.S. patent application Ser. No. 200,552 disclose a false-twist device in which two spindles are swung outwardly about pivot axes which are offset from the axes of the spindles and hence the vertices of the triangle. This arrangement, however, precludes a belt drive of the type described and is extremely expensive.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
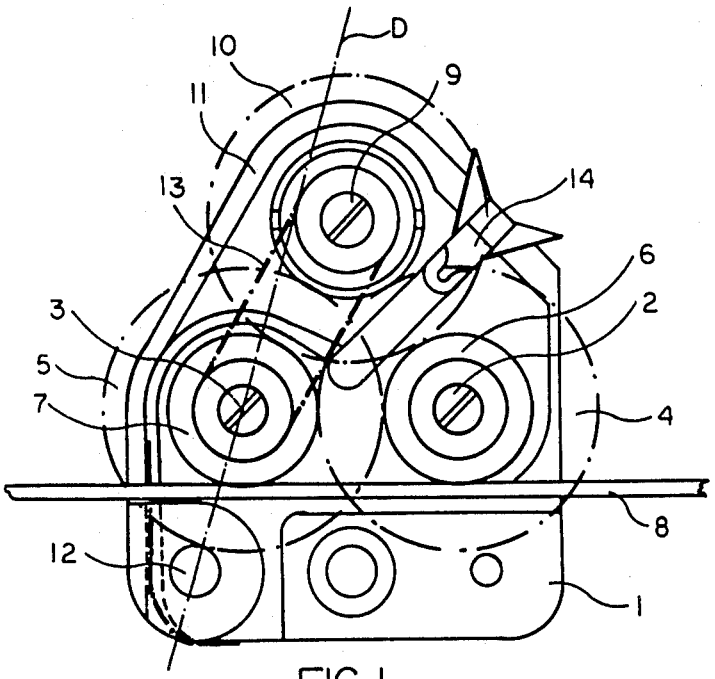
FIG. 1 is a plan view taken generally in a plane transverse to the direction of yarn feed through a false-twist device in accordance with the invention shown in the closed position.

The false-twist device shown in FIG. 1 operates in the manner described in German open application Nos. 2,339,416 and 2,943,279 and U.S. application Ser. No. 200,552 to engage a yarn, not shown, between counter-rotating or codirectionally rotating discs to form a false twist in the yarn.

Figure 2:
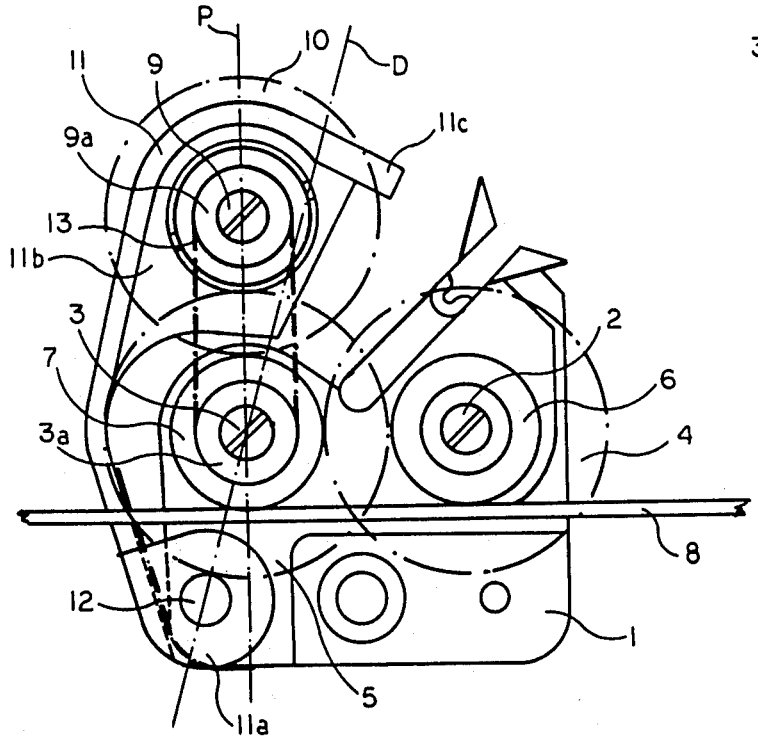
FIG. 2 is a diagrammatical plan view similar to FIG. 1 showing the device in its open position.

In the embodiment of FIGS. 1 and 2, a base plate 1 is mounted upon the machine and rotatably carries a pair of stationarily positioned spindles 2 and 3 each of which has a whorl 6, 7, frictionally engaging the drive belt 8 so that these spindles 2 and 3 are rotated in the same sense. The spindles 2 and 3 carry, as has been shown in dot-dash lines, respective friction wheels 4, 5 and it will be understood that although dot-dash lines, respect friction wheels 4, 5 and it will be understood that although only a single friction wheel is required for each spindle, in general each spindle has at least two such friction wheels and the friction wheels of the spindles interdigitate.

A further spindle 9 is provided on an arm 11 having an eye 11*a* pivotally mounted on a pin 12 forming a pivot for this arm and the spindle 9 on the plate 1. The arm 11 also carries a plate 11*b* supporting a bearing for the spindle 9 and has a tongue 11*c* reaching behind a channel 14 into which the yarns can be threaded in the open position of the wheels (FIG. 2).

The spindle 9 has a sheave 9*a* which is toothed and connected by a cog belt 13 with a toothed sheave 3*a* connected to spindle 3.

As can be seen from FIG. 2, the spindle 9 can be swung so that its friction discs 10 no longer overlap the friction disc 4 so that a yarn to which the false twist is to be imparted can be inserted through the device among the friction discs or removed therefrom.

In this open position, the whorls 6 and 7 continue to be tangentially driven and the belt 13 continues to drive the spindle 9 whereby, upon closure of the device and renewal of the overlapping state of the discs 4 and 10, no particular stress from inertia of a disc, which has to be speeded up, can develop and yarn breakage is held to a minimum.

As can be seen from FIGS. 1 and 2, by orienting the pivot 12 so that it is slightly offset from a plane P connecting the pivot axes of the spindles 3 and 9 and at a distance from the pivot axis 9 substantially greater than the distance between the pivot axes 3 and 9, there is only a slight change in the distance between the axes 3 and 9 during the pivotal movement from the closed position (FIG. 1) to the open position (FIG. 2) thereby resulting in an increase in the distance which must be spanned by the belt 13 which is within the maximum permissible sag of the latter, i.e. is equal to or less than this sag.

Figure 3:
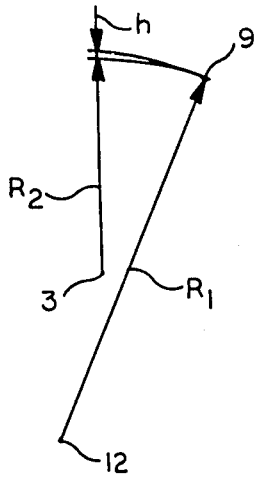
FIG. 3 is a diagram showing a portion of the crescent previously mentioned.

More specifically, as can be seen from FIG. 3 in which the arcs have been exaggerated, a crescent is defined by the movement of the pivot 9 with respect to the axis 3 and the pivot 12 and the crescent has an arc height a which is less than or equal to the maximum permissible belt sag.

$R_1$ represents the distance of the axis of spindle 9 from the pivot 12 while $R_2$ represents the distance between the axis of spindle 9 and the axis of spindle 3.

According to another feature of the invention, also clearly shown in FIGS. 1 and 2, the axes of the pivots 3 and 12 define a dead center position D, the pivot axis 9 swinging between its open and closed positions from one side of this dead center position (right-hand side in FIG. 1) to the opposite side (left-hand side of FIG. 2), whereby the forces on belt 13 tend to maintain the axis on the right-hand side of the dead center position and thus preclude self opening.

We claim:

1. A false-twist device comprising:

a support;

a pair of spindles fixedly positioned on said support but rotatable about respective parallel axes thereof;

a further swingable spindle having an axis parallel to the first mentioned axes and spaced therefrom whereby said axes define the vertices of a triangle;

a first belt for driving at least one of said fixedly positioned spindles;

a second belt, separate from said first belt, connecting said one of said fixedly positioned spindles and said swingable spindle, all of said spindles having friction discs interdigitating or overlapping in a closed position of said swingable spindle and wherein a yarn can be inserted among said discs in an open position of said swingable spindle; and means for pivotally mounting said swingable spindle to enable the angular displacement thereof between said positions about a pivot axis offset from the vertices of said triangle.

2. The device defined in claim 1 whereby said pivot axis is disposed outside said triangle.

3. The device defined in claim 2 wherein said first belt is disposed to tangentially drive both of said fixedly positioned spindles.

4. The device defined in claim 2 wherein said second belt is a cog belt.

5. The device defined in claim 2 wherein said pivot axis is disposed such that the distance between said pivot axis and the axis of said swingable spindle is greater than the distance between said axis of said swingable spindle and the axis of said one of said fixedly positioned spindles.

6. The device defined in claim 1, claim 2, claim 3, claim 4 or claim 5 wherein a crescent is defined between an arc swung by said axis of said swingable spindle about said pivot axis or an arc swung by said axis of said swingable pivot about the axis of said one of said fixedly positioned spindles, the arc height of said crescent being at most equal to the maximum sag of said second belt.

* * * * *